United States Patent [19]

Slobodnik

[11] 4,440,315

[45] Apr. 3, 1984

[54] AUTO FLOW SYSTEM

[76] Inventor: Lev Slobodnik, 185-01 Hillside Ave., Apt. 5-P, Jamacia, N.Y. 11432

[21] Appl. No.: 323,652

[22] Filed: Nov. 20, 1981

[51] Int. Cl.[3] ..... B67D 5/08

[52] U.S. Cl. ..... 222/56; 141/238; 141/198; 137/386

[58] Field of Search ..... 222/56, 52, 65, 64, 222/14, 211, 212, 188, 464, 478; 141/234, 237, 141/238, 242, 198, 192, 195, 196, 95; 137/411, 412, 137/386

[56] References Cited

U.S. PATENT DOCUMENTS

| | | | |
|---|---|---|---|
| 947,468 | 1/1910 | Fish | 222/212 |
| 2,196,323 | 4/1940 | Norton et al. | 222/188 |
| 2,631,827 | 3/1953 | Saxe | 222/56 |
| 3,133,726 | 5/1964 | Tarukawa | 222/56 |
| 3,785,526 | 1/1974 | Shinn | 222/14 |
| 4,108,500 | 8/1978 | Stamer | 222/56 |
| 4,272,824 | 6/1981 | Lewinger et al. | 222/56 |
| 4,284,210 | 8/1981 | Horak | 222/14 |

*Primary Examiner*—Joseph J. Rolla
*Assistant Examiner*—Kenneth Noland
*Attorney, Agent, or Firm*—Richard L. Miller

[57] ABSTRACT

An automatic flow system for an Automixer which provides preset amounts of developer and fixer ingredients to the Automixer on a continuous basis. A plurality of containers are provided with each container having a predetermined volume in accordance with the desired mixing proportions. Control valves respectively control the flow between the containers and the Automixer. A plurality of storage drums are interconnected to the containers by means of additional control valves. The low level signal from the Automixer causes the containers to supply the predetermined volumes to the Automixer. The high level signal from the Automixer causes the storage drums to replenish the supply to the containers.

9 Claims, 3 Drawing Figures

AUTO FLOW SYSTEM

BACKGROUND OF THE INVENTION

This invention relates to an automatic flow system, and more particularly to a control system which automatically provides the necessary ingredients to an automatic mixing device which is utilized for mixing a developer solution and a fixer solution for processing all types of films.

In a typical hospital, photo laboratory, or Radiology Department, a considerable number of x-ray and other films are processed on a regular basis. In order to process such films a developer solution and a fixer solution are needed. The developer solution is typically formed of a combination of ingredients which are mixed together in conjunction with water. Similarly, the fixer solution combines various ingredients in combination with water to form the proper solution. Typically, three ingredients are utilized to form the developer solution and two ingredients form the fixer solution.

In most situations, an automatic mixing device is utilized to form the proper developer and fixer solutions. Such equipment is readily available, with one such piece of equipment being the Kodak Automixer, which is commercially available from the Eastman Kodak Company. In this device, as well as with other similar devices, three individual containers are inverted and placed into appropriate compartments on one side of the Automixer and two containers are inverted and placed in appropriate compartments on the opposing side of the Automixer. The three containers provide their ingredients in conjunction with water to form the developer solution, while the other two containers provide their ingredients, together with water, to provide a fixer solution.

While such device is readily utilized in situations where a large number of films must be processed on a regular basis, there is so much continued changing and replacing of the various containers in the Automixer as to become an almost intolerable burden. Where large volumes of films must be developed, the containers providing the developer and fixer ingredients often must be changed at almost hourly intervals. This continuous replenishing process is one that is most inconvenient, in addition to being expensive and time consuming. Also, it is quite costly to continuously provide the developer and fixer ingredients in small containers.

Accordingly, while the Automixers are of considerable importance, it would be beneficial if a continuous supply of ingredients could be provided to the Automixer. However, the supply to the Automixer must be such that the ingredients are provided in predetermined quantities. Thus, each time the Automixer is replenished, the ingredients must be provided in a predetermined amount in order to maintain the necessary proportions for the developer and fixer mixture solutions. However, while such predetermined amounts must be provided, it will be convenient if there could also be a continuous supply to the Automixer.

SUMMARY OF THE INVENTION

Accordingly, it is an object of the present invention to provide an auto flow system which provides predetermined quantities of ingredients to a mixing device on a continuous basis.

Still another object of the present invention is to provide an automatic flow system which provides predetermined quantities of ingredients to a mixing device from premeasured containers, and wherein the containers are continuously resupplied from storage tanks.

Yet another object of the present invention is to provide an automatic flow system which provides a continuous supply of premeasured quantities of ingredients to a mixing device in accordance with level signals generated from the mixing device.

A further object of the present invention is to provide an automatic flow system which provides proportioned amounts of ingredients to a mixing device, and which utilizes gravity feed where available, and pumping from storage tanks where appropriate.

A further object of the present invention is to provide an automatic flow system which provides predetermined amounts of ingredients to a mixing device, and which includes overflow chambers to preserve any excess ingredients to avoid waste.

Briefly, in accordance with the present invention there is provided an automatic flow system for a mixing device. The mixing device produces level signals corresponding to the quantity of solution in the device. The flow system includes a plurality of containers with each container holding a respective predetermined volume of an ingredient, in accordance with desired mixing proportions. A first plurality of control valves respectively control the flow between the containers and the mixing device. There is also provided a plurality of storage drums. A second plurality of control valves respectively control the flow between the storage drums and the premeasured containers. A control circuit responds to a low level signal from the mixing device for operating the first plurality of control valves so as to supply the mixing device with the predetermined volumes of the ingredients. The control circuit is responsive to a fill level signal from the mixing device for closing the first plurality of control valves and opening the second plurality of control valves so as to refill the container from the storage device.

In an embodiment of the invention, limit switches are provided on each of the containers so as to respond to that container being filled to a predetermined volume. The limit switches serve to terminate the flow from the storage drums to the containers. Any overflow is fed off to overflow receptacles.

Some of the storage drums are provided from supply tanks with pumping devices controlling the flow between the supply tanks and the storage drums. The pumping device is also responsive to the fill level signal for commencing operation, and responds to a high level signal from the mixing device for stopping of further pumping.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

In the typical Automixer, there is provided a mixing chamber for the developer solution and a mixing chamber for the fixer solution. In each of these chambers, there is provided typically four probes with their lower ends terminating at different vertical heights within the chamber. The lowermost probe serves as a common probe. The next upper probe is a low level probe. The fill probe is next in height, and the uppermost probe is a high-level probe.

As the solution in the chamber decreases during operation, it will get lower and lower within the chamber so that finally the quantity of the solution is below all of the probes except the common probe. The electronic circuit within the Automixer detects this condition and in response thereto sends a low level signal which automatically de-energized and closes a transfer valve between mixing tank and holding tank. The valves are typically solenoid valves having coils which are energized in order to open the valve. When the coils are de-energized, the valves are closed.

When the level of the solution will decrease to the low-level probe a signal will be generated to close the transfer valve and a led will flash indicating the necessity to provide additional ingredients.

After the operator replaces the necessary chemical ingredients developer or fixer, the additional chemicals will feed into the chamber so as to cover the low level probe, and the next higher fill probe. When the level of the solution reaches the fill probe the control circuit within the Automixer operates to maintain the transfer valve still closed but opens the water valve. Water is then input into the Automixer so as to mix the chemicals together in the chamber. As the water continues flowing the quantity in the mixing chamber increases until such time as it reaches the high level probe. At that point, the control circuit within the Automixer closes the water valve so as to stop the flow of water into the chamber. It also opens the transfer valve.

The problem with such Automixer is that there must be a continuous replenishing of such ingredients during normal use. The present invention, avoids the necessity of such constant replenishing. At the same time, it makes use of the various level signals produced internally within the Automixer and couples an automatic flow system to the Automixer so as to utilize such level signals in providing a continuous flow of predetermined volumes of chemical ingredients.

Figure 1:
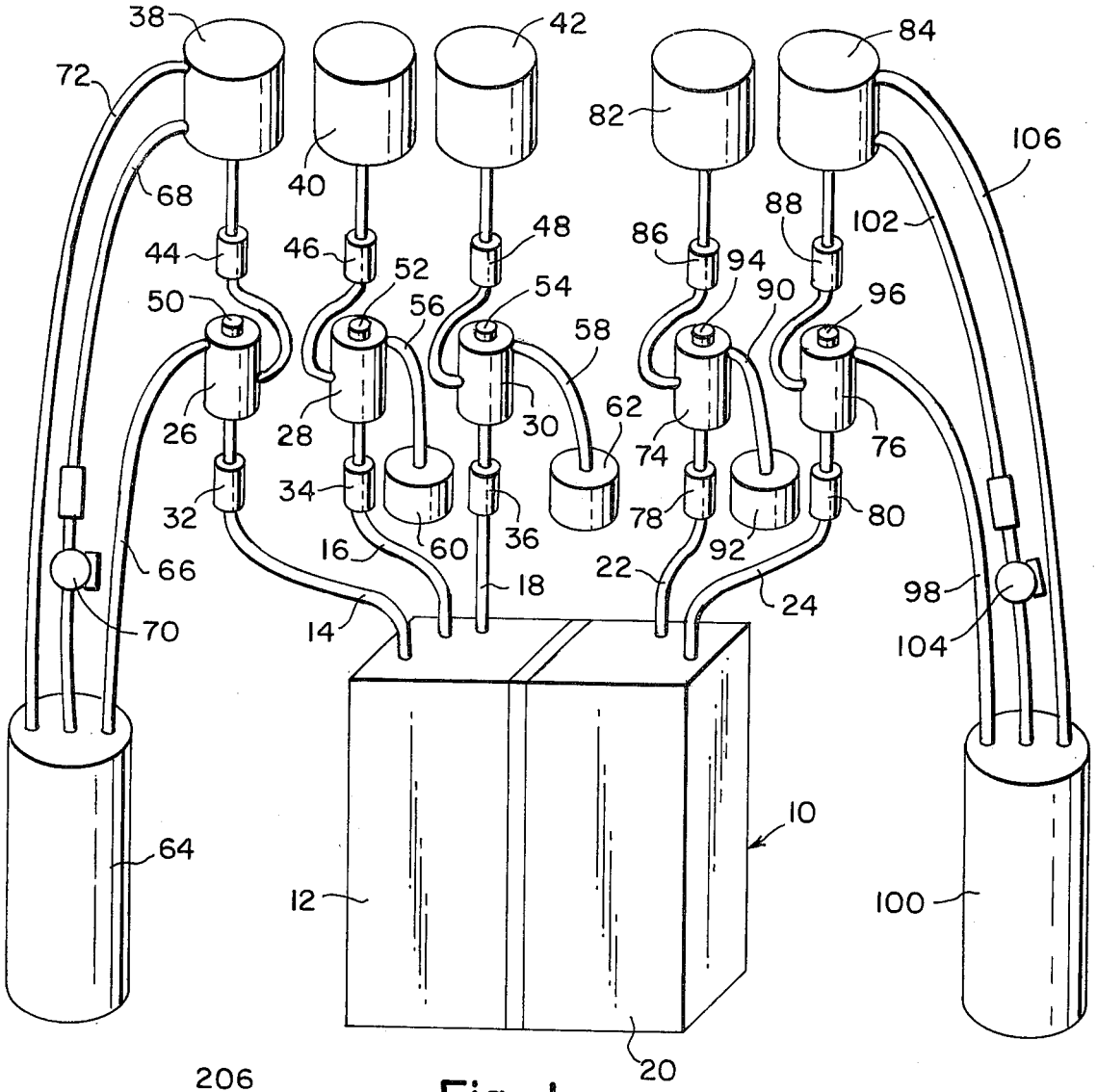
FIG. 1 is a diagrammatic prospective view of the invention.

Referring now to FIG. 1, the auto flow system of the present invention is shown as being interconnected to the Automixer shown generally at 10. The Automixer includes one compartment 12 which receives three ingredients from the flow tubes 14, 16, 18 and which are combined in the chamber 12 to form the developer solution. In the chamber 20, the flow tubes 22, 24 bring in two chemical ingredients which are combined to form the fixer solution within the Automixer.

The three ingredients needed for the developer are contained in measurement containers 26, 28, 30. Each of these contain exactly the right amount of the ingredient in accordance with the proportions needed for the developer solution. The flow from the containers 26, 28, 30 to the mixing chamber 12 of the Automixer 10 is controlled by means of control valves. Specifically, the control valve 32 controls the amount of ingredient from the container 26 flowing through the flow tube 14 into the chamber 12. The control valve 34 controls the flow from container 28 through flow tube 16. Similarly, the control valve 36 control valve 36 controls the flow from the container 30 through the flow tube 18.

Each of the containers 26, 28, 30, are provided with their ingredient from storage drums 38, 40, 42. The flow from these storage drums are controlled by means of additional control valves. Specifically, the control valve 44 controls the flow from the storage drum 38 to the measurement container 26. The control valve 46 controls the flow from the storage drum 40 to the measurement container 28. Similarly, the control valve 48 controls the flow from the storage drum 42 to the measurement container 30.

Each of the measurement containers 26, 28, 30 contains a limit switch 50, 52, 54. The limit switch can typically be of a floatation device or other type. When a predetermined volume of ingredient is provided from the respective storage drums 38, 40, 42 to the respective measurement containers 26, 28, 30, the respective limits switches 50, 52, 54 serve to cut off further supply from the respective storage drums 38, 40, 42.

Should the limit switches 50, 52, 54 not operate or should some other problem occur, overflow equipment is provided. The measurement containers 28, 30 each include an overflow tube 56, 58 which feeds an overflow tank 60, 62. In this way, in the case of any problems, the ingredients are not wasted but are retrieved in the overflow tanks 60, 62.

In the case of the measurement container 26, as will hereinafter be explained, this container is ultimately provided from a supply tank 64 and accordingly the overflow tube 66 feeds back directly into the supply tank 64. The particular ingredients which are utilized in order to provide for the developer solution are each in desired proportions. The proportions needed for the particular ingredients contained in the compartments 28, 30 are less than that supplied from the container 26. Accordingly, the storage drums 40, 42 can maintain a sufficient capacity to provide the ingredients needed for a considerably long period of time. However, the particular ingredient in the container 26 is needed in larger volumes and as a result, the storage drum 38 is insufficient to provide a continuous supply. As a result, an additional supply tank 64 is provided containing the ingredient which ultimately feeds the measurement container 26.

The ingredient is supplied from the supply tank 64 to the storage drum 38 by a feed tube 68. A pumping device 70 located along the feed tube 68 pumps the ingredient to the storage drum. Any excess ingredient from the storage drum 38 can flow back to the supply tank 64 by means of the overflow tube 72.

In the case of the fixer ingredients, only two ingredients are needed and the fixer part of the automatic flow system operates identically to the developer part. Accordingly, it will only be briefly described hereinafter.

Specifically, in the fixer part of the auto flow system, the measurement containers 74, 76 provide the ingredient through the flow tubes 22, 24 to the fixer chamber 20 of the auto mixer 10. The flow is controlled by means of the control valves 78, 80. The measurement containers 74, 76 are respectively fed from the storage drums 82, 84 by means of the control valves 86, 88. The measurement container 74 includes the overflow tube 90 which feeds the overflow tank 92 to salvage any excess which overflows should its limit switch 94 not operate.

Another switch 96 on the measurement container 76 also is provided. Should an overflow occur from the measurement container 76, it passes through the overflow tube 98 into the supply tank 100.

The supply tank 100 provides the ingredient to the storage drum 84 through the feed tube 102 controlled by the pump 104. An overflow tube 106 is provided from the storage drum 84 back to the supply tank 100.

Figure 3:
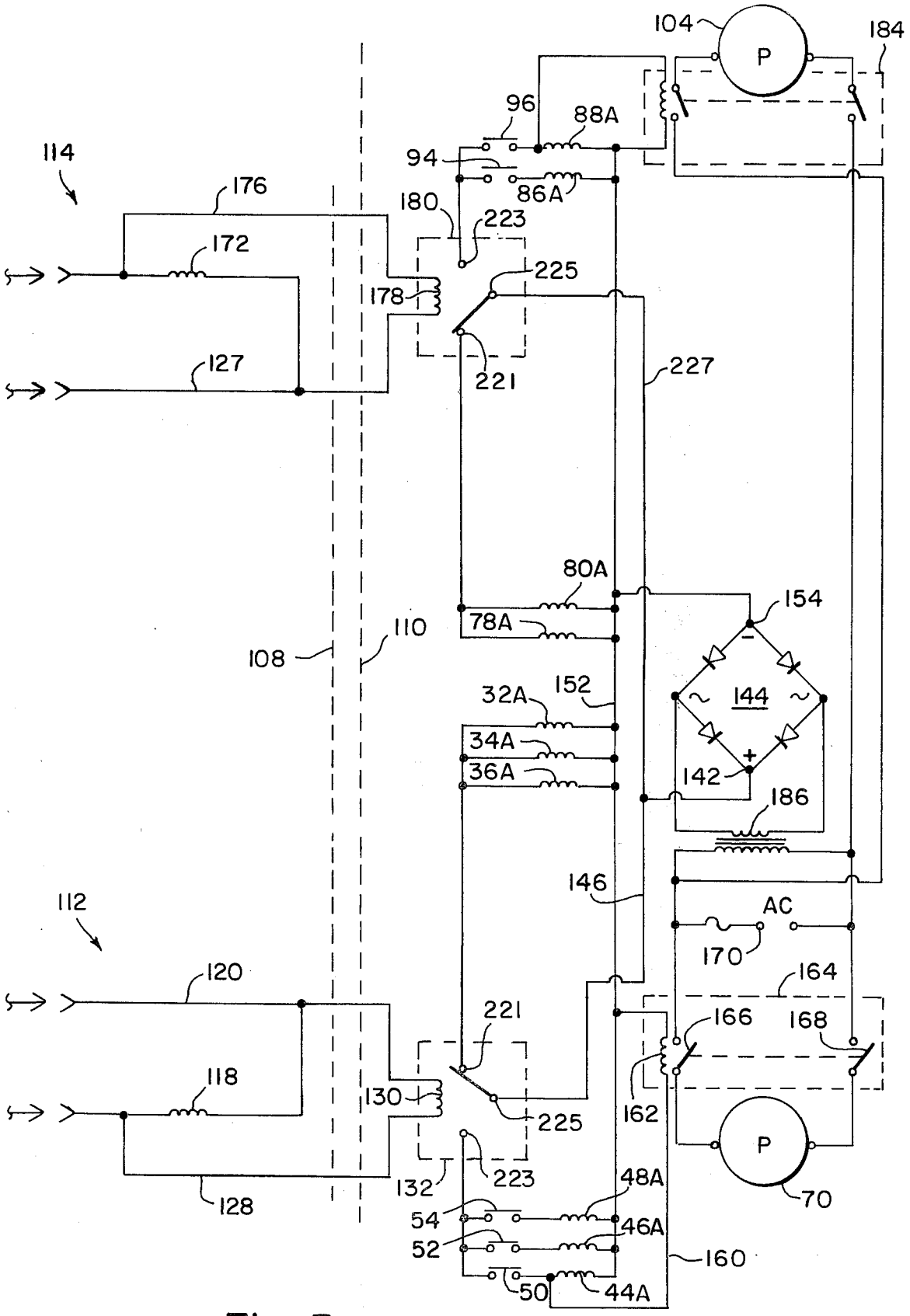
FIG. 3 is a schematic circuit drawing of the invention.

The particular circuitry necessary to control the operation of the various control valves is shown in detail in FIG. 3. The portion to the left of the dotted line 108 is the portion of the circuit already contained in the Automixer. The portion to the right of the dotted line 110 is the circuitry provided in the present Autoflow system.

Within the Automixer the lower portion of the circuit 112 relates to the developer chamber while the upper circuit 114 relates to the fixer circuit. The solenoid 118 in the developer circuit controls the developer transfer valve. When energized, these solenoid cause the valve to open in Automixer. Line 120 provides a return flow for the current passing through the solenoid.

Solenoid 118 of the developer transfer valve and relay coil of the developer transfer relay 132 are connected in parallel by conductor 128 and common line 120. When the Automixer detects that the developer solution level is low, it sends a low level signal which causes the de-energization of the transfer valve solenoid 118 and relay 132 in Autoflow system so that contacts 225 and 221 are closed in their normally closed position. As a result the coils of valves 32A, 34A, and 36A will be energized.

Current path to the coils will flow from the positive terminal 142 of rectifier 144, through line 146, contacts 225 and 221, relay 132, coils of valves 32A, 34A, and 36A, line 152 and back to the negative terminal 154 of the rectifier to com plete the circuit. Energization of the coils 32A, 34A, and 36A serves to open the valves 32, 34, 36 which thereby sends the predetermined amount of the ingredients contained in the measurement containers 26, 28, and 30 in the developer section of the Automixer.

When the level of the predetermined measured amount of each of the three ingredients which come from the measurement containers 26, 28, and 30 into the developer mixing chamber, reaches the fill probe a fill level signal is produced in the Automixer, and such signal serves to open the water valve in the Automixer.

During this time, water will automatically enter the Automixer so as to produce the desired developer solution. When the level of the solution reaches the high level probe a high level signal is produced to energize the coil 118 of transfer valve and relay 132 in Autoflow system, and water valve will be closed in Automixer. As a result the coils of valves 32A, 34A, and 36A de-energize and valves 32, 34, and 36 will be closed.

At the same time coils of 44A, 46A, and 48A of valves 44, 46, and 48 will be energized through the contacts 225 and 223 of relay 132. Current path to the coils will flow from the positive terminal 142 of rectifier 144, line 146, contacts 225, and 223, relay 132, limit switches 50, 52 and 54, coils of valves 44A, 46A, and 48A, line 152, and back to the negative terminal 154 of the rectifier to complete the circuit. As a result the coils of valves 44A, 46A, and 48A will be energized.

With the coils 44A, 46A and 48A energized, relay 162 which is in parallel with coil 44A will energize the valves 44, 46, and 48 will open causing the chemical ingredients from the storage drums 38, 40 and 42 to refill the measurement containers 26, 28 and 30. Such refilling will continue until the preset limit switches 50, 52 and 54 sense that the desired amount of ingredients to be maintained in the containers 26, 28 and 30 have been achieved. At that point, the limit switches 50, 52 and 54 will open. When each of the switches opens, it respectively de-energizes the coil of that valve to thereby cause the valve to close stopping any further flow into the measurement container, and stopping the pump 70 because limit switch 50 has opened.

It will therefore be appreciated, that upon occurrence of the low level signal from the Automixer, the auto flow circuit shown in FIG. 3 will cause the valves 32, 34 and 36 to open thereby sending the prefixed amount of chemical ingredients into the developer. Upon occurrence of the high level condition in the Automixer, the valves from the containers to the Automixer will be closed stopping any further flow into the Automixer. However, the valves from the storage drums to the container will automatically open thereby refilling the measurement containers. When the prefixed amount of chemical ingredients in each of the containers is reached, the valves will automatically close thereby stopping any further ingredients from filling the measuring containers, because, the pump 70 de-energizes when limit switch 50 is opened.

In the upper part of FIG. 3, there is shown the fixer portion of the circuit 114. In this case, there is provided a coil 172 controlling the fixer transfer valve. The lines 176 are respectively interconnected to these solenoid so as to energize the coils contained in their respective relay 180. Upon reaching a low level condition in the mixing chamber of the fixer section, the fixer transfer valve will be closed. This will cause the relay 180 to de-energize, and contacts 225, and 221 to be closed thereby causing energization of the solenoid coils 78A and 80A so as to open the valves 78 and 80 thereby sending the ingredients from the measurement compartments 74, 76 into the fixer mixing chamber in the Automixer.

When the level of the predetermined measured amounts of each of the two ingredients which come from the measurement containers 74, and 76 into the fixer mixing chamber reaches the fill probe, a fill level signal is produced in Automixer. Such signal serves to open the fixer water valve in the Automixer.

During this time, water will automatically enter the Automixer so as to produce the desired fixer solution. When the level of the solution reaches the high level probe a high level signal is produced to energize the coil 172 of a transfer valve in Automixer and energized relay 180 contacts 225 and 223 closed in auto flow system. Water valve will be closed in Automixer also. As a result the coils of valves 78A, and 80A de-energizes and valves 78 and 80 will be closed. At the same time coils of 86A and 88A of valves 86 and 88 will be energized through the contact pair 225 and 223 of relay 180. Current to the coils will flow from the positive terminal 142 of rectifier 144, line 227, contacts 225, and 223, relay 180, limit switches 94 and 96, coil of valves 86A and 88A, line 152, and back to the negative terminal 154 of the rectifier to complete the circuit.

As a result the coils of valves 86A and 88A will be energized simultaneously with relay 184 which is in parallel with coil 88A causing the pump 104 to also be activated. This will cause the control valves 86, and 88 to open thereby refilling the measurement containers 74, and 76, from their storage tanks 82, and 84. When the limit switches 94, and 96 indicate that the desired measurement has been reached in the containers 74, and 76 these limit switches will respectively also de-energize the valve coils 86A, and 88A and the control valves 86, and 88 will be closed and thus cause pump 104 to stop pumping.

The rectifier 144 is energized by means of the AC power line 170 through the step down transformer 186.

It will therefore be appreciated, that with the present invention, the Automixer can be utilized without the necessity of continuously replenishing the supplies. At the same time, each time the solution in the Automixer requires replenishing, a predetermined amount of the various chemical ingredients will be supplied so as to maintain the ratio and proportion of the needed developer and fixer solutions.

Utilizing the present Auto flow system, time is saved in not requiring reloading of the mixer many times a day. With this system, the mixer can work a few weeks or a month without touching it. The financial profit in using the auto flow system can be considerable. The chemical ingredients can now be purchased in larger drum capacities rather than the usual small container size.

By placing the various containers vertically one above the other, use of gravity can be achieved in having the flow from the storage drums into the container, and correspondingly from the containers into the Automixer.

Figure 2:
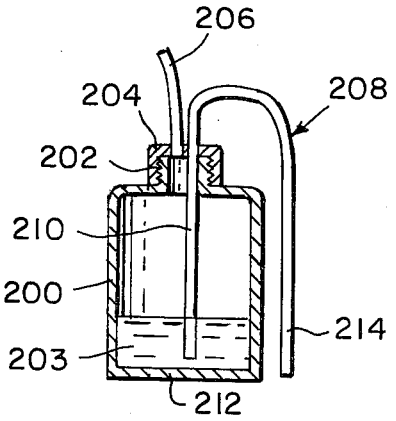
FIG. 2 is a cross sectional view showing the construction of a typical receptacle serving as a storage drum.

With reference now to FIG. 2, a particular embodiment of the storage drum will be shown which has been found most effective. The drum itself includes a receptacle 200 which is filled by placing the receptacle in the upright condition. The mouth of the receptacle 202 includes an upwardly extending stem with an outwardly threaded periphery. The mouth is open for filling and the particular solution of chemical ingredient 204 can be placed into the receptacle 200. A cover 204 is then placed onto the mouth stem, typically by threading it onto the stem. It will be noted that the mouth cover 204 has two openings. An outlet tube 206 extends into one of the openings in the cover 204. A second tube 208 extends into the other opening. The tube 206 terminates proximate the mouth. The tube 208 extends with its one leg 210 continuing into the receptacle 200 and adjacent the bottom 212 thereof so as to extend into the liquid solution. The other leg 214 extends outwardly of the receptacle 200 and as shown extends to a plane lower than the other leg 210.

After the receptacle has been filled and the cover 204 placed in position with its two tubes, the receptacle 200 is inverted and can serve as one of the drums 40, 42 or 82. In the inverted position, the fluid flows out of the receptacle to the outlet 206. The other tube 208 serves as a vent.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

What is claimed is:

1. An automatic flow system for a mixing device which produces level signals corresponding to the quantity of the solution in the device, said system comprising:

a plurality of containers, each retaining a respective predetermined volume in accordance with desired mixing proportions;

a first plurality of control valves respectively controlling the flow between said containers and said device;

a plurality of storage drums;

a second plurality of control valves respectively controlling the flow between said storage drums and said containers;

a control circuit responsive to a low level signal from said mixing device for operating said first plurality of control valves to supply said mixing device with said predetermined volumes, and responsive to a high level signal for closing said first plurality of control valves and opening said second plurality of control valves to refill said containers from said storage drums; and said system further comprising at least one supply tank coupled to a corresponding one of said storage drums, and pump means controlling the flow between said supply tank and said corresponding storage drum, said pump means responsive to the high level signal for commencing operation, and stop operation by means of the limit switch on one of said plurality of containers.

2. An automatic flow control system as in claim 1, and further comprising a limit switch on each of said containers responsive to the respective container being filled to a predetermined volume and coupled to said control circuit for causing closure of the corresponding one of said second plurality of control valves thereby terminating the flow from the corresponding storage drum to that container.

3. An automatic flow system as in claim 1, and further comprising a respective overflow tank associated with at least some of said containers for storing any overflow from the respective container.

4. An automatic flow system as in claim 1, and further comprising an overflow tube from said corresponding storage drum to said supply tank, and a further overflow tube from the container fed by said corresponding storage drum to said supply tank.

5. An automatic flow system as in claim 1, wherein said containers are positioned above said mixing device, and said storage drums are positioned above said containers, whereby said containers and said mixing device are fed by a gravity feed arrangement.

6. An automatic flow system as in claim 1, wherein at least some of said storage drums each comprise a receptacle having an open top for filling of the receptacle in an upright position, a closure member for closing the top of the receptacle, and outlet tube coupled to said closure member through which the contents of the receptacle can flow with the receptacle in an inverted position, and a U-shaped vent tube having one leg passing through said closure member and extending into said receptacle adjacent to the bottom thereof and the other leg extending outside of said receptacle.

7. An automatic flow system as in claim 1, wherein said control valves are solenoid valves which open upon energization of the solenoid.

8. An automatic flow system as in claim 1, wherein said control circuit comprises relays having a coil portion energized by the presence of a level signal and a switch portion coupled to said control valve for activating them.

9. An automatic flow system as in claim 1, wherein said device is an Automixer and said storage drums supply components of a developer and a fixer to the Automixer.

* * * * *